United States Patent [19]

Frame

[11] 4,274,028

[45] Jun. 16, 1981

[54] ULTRAVIOLET LIGHT GENERATION

[75] Inventor: Norman J. Frame, Milwaukee, Wis.

[73] Assignee: W. H. Brady Company, Milwaukee, Wis.

[21] Appl. No.: 66,059

[22] Filed: Aug. 13, 1979

Related U.S. Application Data

[63] Continuation of Ser. No. 948,978, Oct. 5, 1978, abandoned.

[51] Int. Cl.[3] ..... H01J 63/06; H01J 40/06; H01J 31/50

[52] U.S. Cl. ..... 313/101; 313/102; 313/495

[58] Field of Search ..... 313/94, 101, 102, 495, 313/467, 468; 250/504, 213 VT

[56] References Cited

U.S. PATENT DOCUMENTS

| | | | |
|---|---|---|---|
| 1,724,298 | 8/1929 | Miller | 313/102 X |
| 2,548,118 | 4/1951 | Morton et al. | 313/101 X |
| 2,603,757 | 7/1952 | Sheldon | 313/101 |
| 2,834,903 | 5/1958 | Roberts . | |
| 2,909,692 | 10/1959 | Cusano . | |
| 2,962,546 | 11/1960 | Thompson | 313/471 X |
| 3,107,303 | 10/1963 | Berkowitz | 313/495 X |
| 3,363,240 | 1/1968 | Cola et al. | 313/495 X |
| 3,375,391 | 3/1968 | Day | 313/102 X |
| 3,585,433 | 6/1971 | O'Keefe et al. | 313/101 X |
| 3,662,175 | 5/1972 | Davidson et al. | 313/225 X |
| 3,790,867 | 2/1974 | Hayakawa | 250/213 X |
| 3,894,258 | 7/1975 | Butterwick | 313/102 |
| 4,069,438 | 1/1978 | Houston et al. | 313/346 R |
| 4,092,557 | 3/1978 | Mulder | 313/102 |

OTHER PUBLICATIONS

"Research On Cold Cathodes", Final Report prepared by The Stanford Research Institute for the NASA Goddard Space Flight Center under contract NAS 5-9581, pp. 30-32.

"*Inside R&D*", vol. 7, No. 6, (Feb. 8, 1978).

"Optical Characteristics of Cathode Ray Tube Screens", published by Electronic Industries Association Eng. Dept., JEDEC Pub. No. 16-B, pp. 14, 39.

*Primary Examiner*—Palmer C. Demeo

[57] ABSTRACT

Apparatus for generating ultraviolet light of high intensity without production of heat, including an anode cathodoluminescent layer composed of a phosphor luminescent in the ultraviolet spectrum, a cold cathode electron emitting layer separated by an evacuated region from the cathodoluminescent layer, and a direct current electric field generated between cathode and anode across the evacuated region.

15 Claims, 6 Drawing Figures

FIG 1
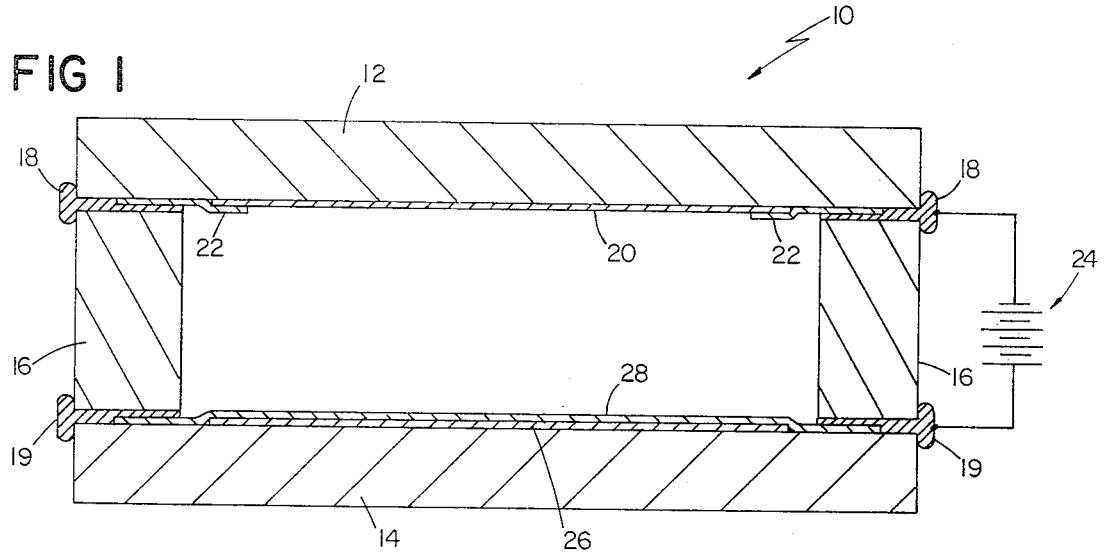
FIG 2
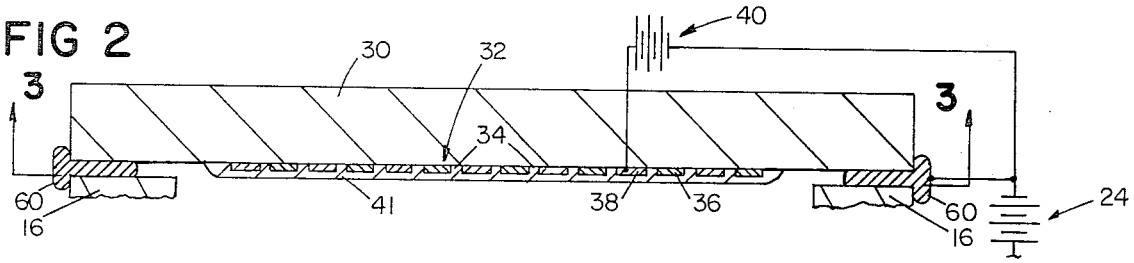
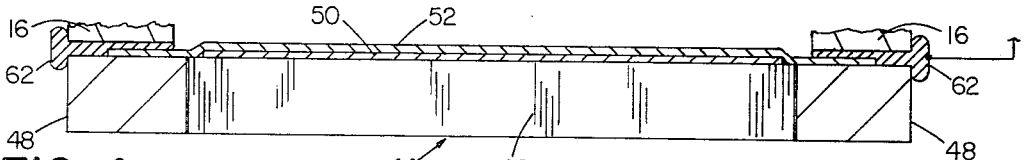
FIG 4
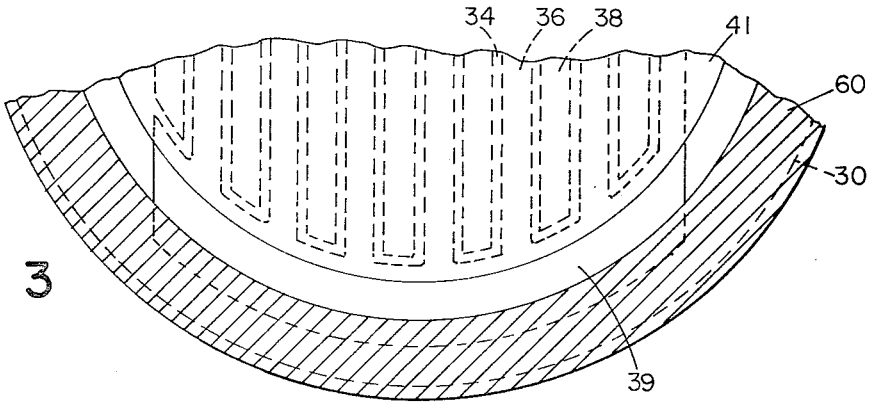
FIG 3

ULTRAVIOLET LIGHT GENERATION

This is a continuation of application Ser. No. 948,978, filed Oct. 5, 1978, and now abandoned.

BACKGROUND OF THE INVENTION

In curing ultraviolet-sensitive layers and in other applications employing ultraviolet light, it is desirable to have a means of generating a high-intensity ultraviolet image or an unresolved ultraviolet flooding beam. Visible-light lamps are a conventional source of ultraviolet radiation, but only a very small percentage of the total radiation they emit is ultraviolet, resulting in tremendous energy waste, much of it in the form of bothersome heat.

Prior art night-vision devices, such as those employed by the military, provide amplification of visible light by converting incoming visible light to electrons, accelerating the electrons across a strong electric field through hollow fibers the inside surfaces of which emit additional electrons, and converting the amplified electron radiation to visible light at a phosphor screen.

An article in *Inside R&D,* Vol. 7, No. 6, published Feb. 8, 1978, discloses a thin panel CRT tube of Texas Instruments that includes a matrix of area cathode electron emitters spaced in back of a screen coated with visible-light luminescing phosphors, all inside an evacuated chamber.

Houston et al. U.S. Pat. No. 4,069,438 shows a device for producing an electrostatic image of an X-ray beam on a Mylar sheet. The X-ray beam strikes an ultraviolet fluorescent layer such as $BaSO_4$:Pb, the ultraviolet light thus produced passes through a quartz layer to a layer of ultraviolet-sensitive electron-emitting material, the emitted electrons pass through a gas filled region under the influence of an electric field to ionize the gas, and a Mylar insulating layer is positioned at the anode so as to be struck by the ions produced.

SUMMARY OF THE INVENTION

I have discovered a means of generating ultraviolet light of high intensity without production of heat. A cold cathode electron-emitting layer is separated by an evacuated region from an anode cathodoluminescent layer composed of a phosphor luminescent in the ultraviolet spectrum, and a direct current electric field is generated between cathode and anode across the evacuated region.

In a most preferred embodiment the electron-emitting layer is gold exposed to ultraviolet radiation through a quartz input window. In said embodiment, a flood beam of ultraviolet light may be generated by exposing the gold layer to unresolved ultraviolet radiation, or an incoming ultraviolet image incident upon the gold layer may be amplified, the corresponding electron image emitted by the gold layer, in turn, causing the cathodoluminescent layer to emit a corresponding amplified ultraviolet image.

In a further preferred embodiment, the electron-emitting layer comprises two electrodes consisting of finely spaced interleaved fingers, all thinly deposited on the undersurface of a glass plate and covered by a magnesium oxide semiconductor layer which generates electrons when an electric field is applied across the electrodes. In a still further preferred embodiment, where ultraviolet image intensification is desired, a fiber-optic plate transmits the ultraviolet emissions of the cathodoluminescent layer to the output surface, thereby improving resolution.

Because the invention provides high intensity ultraviolet radiation without significant heat production, it makes possible curing emulsions at close proximity to the ultraviolet source, thereby raising intensity levels in proportion to the square of the shortening of distance and thus speeding curing. A further advantage is that uniform-intensity radiation can easily be applied across a wide area making for eased curing of wide materials.

PREFERRED EMBODIMENTS

We turn now to the structure and operation of preferred embodiments of the invention, after first briefly describing the drawings.

Drawings

FIG. 1 is a cross sectional, somewhat diagrammatic, view of the most preferred embodiment of the invention.

FIG. 2 is a fragmentary cross sectional, somewhat diagrammatic, view of another preferred embodiment of the invention.

FIG. 3 is a fragmentary view taken through 3—3 of FIG. 2 looking up at the upper plate and showing the electrode pattern.

FIG. 4 is a fragmentary cross sectional view of an alternative output window structure suitable for use with the embodiments of both FIGS. 1 and 2.

STRUCTURE

Figure 5:
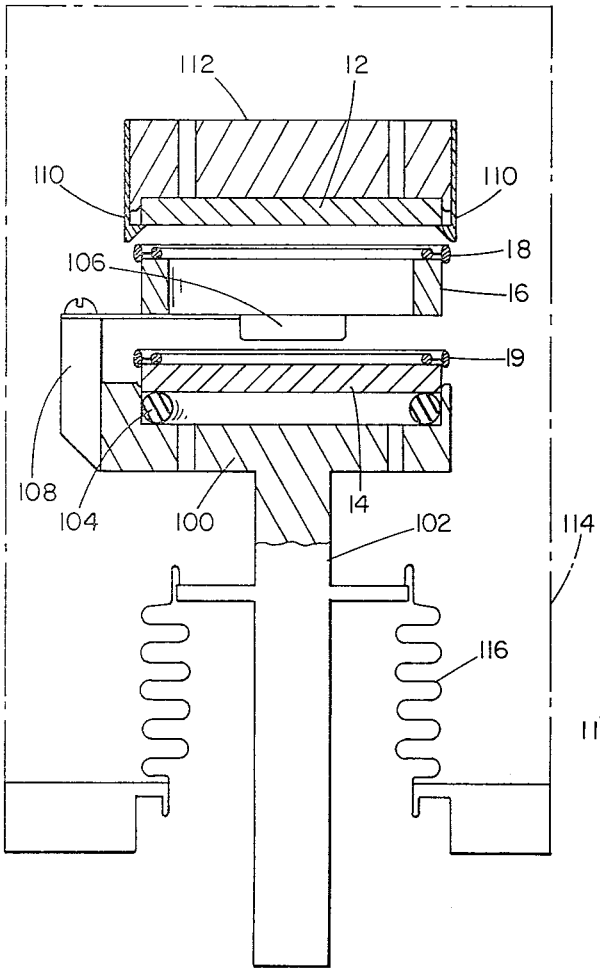
FIG. 5 is a cross sectional, somewhat diagrammatic, view of apparatus used in final assembly of said embodiments, showing the windows and spacer tube spaced apart for outgassing.

Referring to FIG. 1, there is shown an evacuated ultraviolet amplifier tube 10. Input window 12 is spaced from output window 14 by a 5 mm length of borosilicate glass tubing 16. Mechanically-pressed cold indium seals 18, 19 provide hermetic seals between windows 12, 14 and tubing 16.

Input window 12 is a quartz plate optically ground and polished to have parallel, planar surfaces. Gold layer 20 is vacuum deposited on the inside surface of window 12 to a 600 angstrom thickness, which is sufficient to reduce incandescent light transmission by 50%. Aluminum layer 22 is vacuum deposited over the radially outer edge of gold layer 20 to 2500 angstrom thickness using an evaporation mask. Layer 22 overlaps layer 20 by 1.25 mm. and extends to within 1.0 mm. of the edge of window 12. Indium seal 18 contacts layer 22, the two providing together an electrical path between voltage source 24 and gold layer 20.

Output window 14 is a 3 mm. thick quartz plate identical to input window 12. Cathodoluminescent layer 26 consisting of ultraviolet phosphor $BaSi_2O_5$:Pb is settled on the inside surface of window 14 at a density of 3 $mg/cm^2$ by the conventional potassium silicate-barium acetate process.

Aluminum layer 28 is vacuum deposited over the phoshpor to a thickness of 3000 angstroms and extends to with 1.0 mm. of the window edge to contact indium seal 19 to provide an electrical path to voltage source 24, which provides a 20 kilovolt potential across the 5 mm. spacing between the windows.

Referring to FIG. 2, there is shown the upper portion of another preferred embodiment, wherein electrons are internally generated. This embodiment has the same output window and glass tubing as shown in FIG. 1. Upper plate 30 is 3 mm. thick glass optically ground and polished on its inside surface. Aluminum electrode grid 32 is formed on the inside surface of plate 30 by vacuum depositing aluminum to a thickness of 200 angstroms and then vaporizing a 12 micron wide convoluted gap 34 (FIG. 3) using a laser beam focused to that width. This leaves two electrodes consisting of 200 micron wide electrode fingers 36, 38 interleaved with each other. Electrode 36 has outer portion 39 interconnecting the fingers and extending radially outward to contact indium seal 60 (FIG. 3), thereby connecting electrode 36 with the ground sides of voltage sources 24 and 40. Electrode 38 is isolated from indium seal 60 and connected through a pin piercing input substrate 30 to the positive side of voltage source 40. The positive side of voltage source 24 is connected, as in the embodiment of FIG. 1, to the lower indium seal. Voltage source 40 applies a 20 V.D.C. potential across the grid. Magnesium oxide film 41 is vacuum deposited over grid 32 to a thickness sufficient to produce a current of 100 microamperes with 100 volts D.C. applied at source 40. This cold cathode structure is shown in the Final Report prepared by the Stanford Research Institute for the NASA Goddard Space Flight Center under Contract NAS 5-9581, entitled "Research on Cold Cathodes".

Turning to FIG. 4, there is shown an alternative output window structure 44 for use in place of the output window of FIG. 1 and in conjunction with the upper portions of either FIG. 1 or FIG. 2. Fiber-optic plate 46 consisting of quartz optical fibers is sealed with glass frit into the center of annular glass plate 48 to form output window 44. Window 44 is sealed to tube 42 by indium seal 62. Cathodoluminescent layer 50 and aluminum layer 52 identical to layers 26 and 28, respectively, are deposited on the inner surface of window 44 over fiber-optic plate 46.

In manufacturing, a $1\times10^{-7}$ torr vacuum is maintained during depositing of the various layers, and, if input window 12 is produced before final assembly of the entire amplifier, it is stored in an environment suitable for preventing formation of aluminum oxide.

To prevent desorption of gases from the layers during operation and concomitant failure of the amplifier due to field breakdown, the apparatus of FIG. 5 is used for outgassing the tube prior to and during final assembly. Referring to FIG. 5, platform 100 supported on vertical rod 102 supports output window 14 above elastomeric ring 104. Uncompressed indium seal 19 rests on the upper surface of window 14. Glass tubing 16 is supported spaced above output window 14 by a pair of camming fingers 106 extending from arm 108. Uncompressed indium seal 18 rests on the upper surface of tubing 16. Input window 12 is held spaced above tubing 16 by a pair of camming fingers 110 extending downward from upper fixture 112. The entire assembly is held within a vacuum chamber 114, which is sealed at rod 102 by bellows 116.

Figure 6:
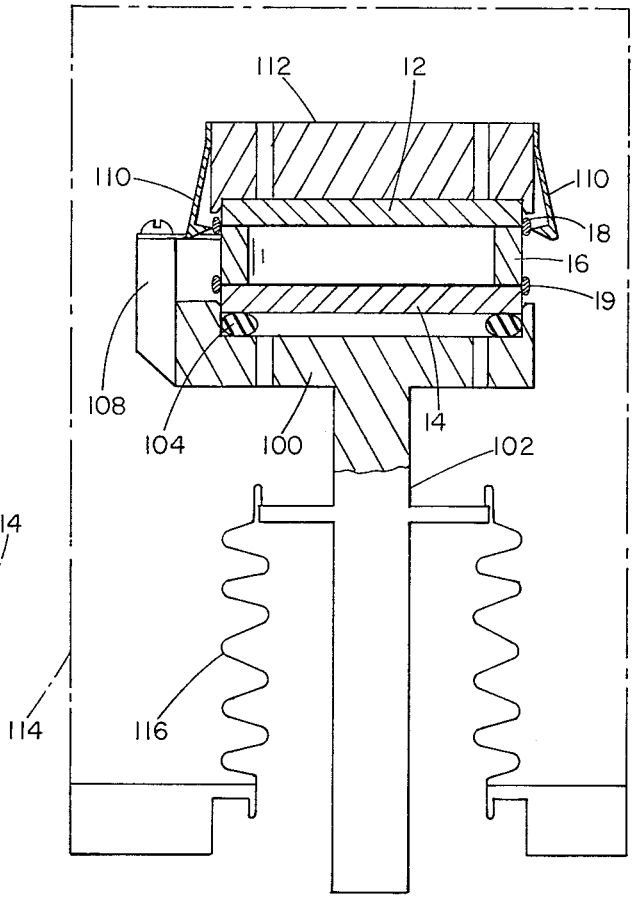
FIG. 6 is a cross sectional, somewhat diagrammatic, view of the apparatus of FIG. 5 during application of a compression force for final sealing.

With windows 12, 14 and tubing 16 spaced apart as shown in FIG. 5, an electric potential of higher than normal operating level is applied between anode and cathode layers (using electrical connections not shown in the figure). Sufficient spacing is provided between windows 12, 14 and tubing 16, to allow the desorbed gases to be rapidly drawn off by a diffusion pump (not shown) which is evacuating chamber 114. After the vacuum stabilizes at $5\times10^{-7}$ torr, platform 100 is raised and a compressive force equal to 100 lbs. per lineal inch of indium seal is applied to indium seals 18, 19 by means of rod 102. Elastomeric ring 104 transfers the force to the radial location of the indium seals. Camming fingers 106, 110 are moved outward and clear of the tube by upward movement of the indium seals (as shown for fingers 110 in FIG. 6). Once the indium seals are compressed, pressure in chamber 114 is brought up to atmospheric and the tube is removed. The adhesive properties of the indium-glass seal and atmospheric pressure on windows 12, 14 hold the windows tightly pressed against tubing 16.

OPERATION

In operation of the most preferred embodiment shown in FIG. 1, weak unresolved ultraviolet radiation passes through input window 12 and impinges on gold layer 20, where it causes a uniform cloud of electrons to be emitted into evacuated region 80. The electrons are accelerated by the strong electric field (4 kilovolts/mm) until they impinge on layers 26, 28. There the electrons cause the phosphor to luminesce and intense ultraviolet radiation is emitted in a flood beam. Masking can be used between the output window and the ultraviolet emulsion to produce character images. Ultraviolet-sensitive emulsions are cured by placing them in close proximity to output window 14.

In operation of the embodiment of FIG. 2, no input radiation is used. Instead a 20 V.D.C. electric field is applied by source 40 between electrodes 36 and 38 to cause magnesium oxide layer 41 to emit electrons which are accelerated the short distance to layers 26, 28, where a flood beam of ultraviolet radiation is generated in the manner described above.

To use the embodiments of FIGS. 1 and 2 to produce resolved output images, rather than as light sources, two steps are taken to improve resolution. First, quartz fiber-optic output window 44 of FIG. 4 is substituted for window 14 of FIG. 1, thus assuring no loss of image resolution between cathodoluminescent layer 50 and the outside surface of window 44. Second, the 5 mm. spacing between input and output windows is reduced to 1.5 mm. and the potential of voltage source 24 is reduced to 12 kilovolts to reduce electron scattering between cathode and anode. This choice of spacing and electric potential represents a compromise between loss of brightness and improved resolution. Resolution suffers in proportion to the square of the gap between the windows and in linear proportion to the magnitude of the electric field. On the other hand, output brightness increases in linear proportion to the magnitude of the total potential across the field because phosphors luminesce more brightly when excited by higher energy electrons. And, of course, breakdown of the electric field places an upper limit on potential at any given gap. Where improved resolution is desired, it may be desirable to lower the applied potential and decrease the gap from these preferred figures.

With the structure of FIG. 1 so modified, input window 12 is exposed to a resolved ultraviolet image, such as by contact exposure of a transparency on the outside surface of the window. The incoming image causes gold layer 20 to emit a corresponding electron image, and the electrons, in turn, cause luminescence of a corresponding amplified ultraviolet image at cathodoluminescent layer 26, the image then being transmitted without loss of resolution through fiber optic plate 46.

With the same modifications made, the embodiment of FIG. 2 can be used to produce resolved output images by dividing the electrode grid into a matrix of insulated smaller grids, each representing one element of an alphanumeric character.

OTHER EMBODIMENTS

Other embodiments are within the scope of the following claims and will occur to those skilled in the art. For example, glass tube 16 could have a rounded rectangular shape for larger size amplifiers to reduce bending of the plates and concomitant leakage at the indium seals; other ultraviolet-emitting phosphors could be used, including $Y_2O_3$:Gd and $BaZnSi_4O_{10}$:Pb, each with different spectral energy content; different metals could be used in the various layers, aluminum substituting for gold in layer 20 and gold or silver for aluminum in electrodes 36,38; lens systems could be used at the input and output windows to transmit images; and a floodlight lens could be used at the output window to spread the width of the output radiation.

What is claimed is:

1. Apparatus for generating high intensity ultraviolet light, comprising
   - an input substrate,
   - an electron-emitting cathode layer on said input substrate,
   - an output window,
   - a cathodoluminescent anode layer on said output window, said layer comprising phosphor luminescent in substantially only the ultraviolet spectrum,
   - an evacuated region separating said cathode and anode layers, and
   - a D.C. voltage source connected across said layers for generating a longitudinal electric field,
   - whereby electrons emitted by said cathode layer are accelerated by the electric field through said evacuated region and impinge on said cathodoluminescent layer causing a substantially pure, high-intensity ultraviolet light output through said output window.

2. The apparatus of claim 1 wherein
   - said electron-emitting cathode layer comprises an ultraviolet-sensitive layer which emits electrons when exposed to ultraviolet radiation and
   - said input substrate comprises an input window transmissive of ultraviolet light,
   - whereby ultraviolet light entering said input window causes electrons to be generated by said ultraviolet-sensitive layer.

3. The apparatus of claim 2 wherein said ultraviolet-sensitive layer is gold.

4. The apparatus of claim 1 wherein said electron-emitting cathode layer comprises
   - two electrodes consisting of coplanar, finely-spaced, interleaved fingers thinly deposited on said input substrate,
   - a second D.C. voltage source connected to said two electrodes, and
   - an electron-emitting layer deposited over said two electrodes and composed of material which emits electrons when exposed to an electric field,
   - said electron-emitting layer emitting electrons when excited by a second electric field generated within it by said two electrodes transversely to said longitudinal electric field.

5. The apparatus of claim 4 wherein said electron-emitting layer is a semiconductor material.

6. The apparatus of claim 5 wherein said semiconductor material is magnesium oxide.

7. The apparatus of claim 1 wherein said cathodoluminescent anode layer comprises
   - a layer of said ultraviolet-luminescent phosphor deposited on said output window and
   - a conductive metal layer deposited over said phosphor layer.

8. The apparatus of claim 7 further comprising
   - a non-conductive tube spacing said input substrate from said output window and forming with said substrate and window said evacuated region and
   - sealing means between said substrate and said tube and between said window and said tube.

9. The apparatus of claim 8 wherein said sealing means comprises indium seals compressed between said tube and said substrate and window, said seals providing an electrical path between said voltage source and said anode and cathode layers.

10. The apparatus of claim 1 wherein said output window comprises a fiber optic plate with longitudinally aligned fibers for maintaining resolution of the ultraviolet radiation emitted by said cathodoluminescent layer.

11. The apparatus of claim 2 further comprising means of exposing said input window with unresolved ultraviolet light, said light thereby generating unresolved electron radiation and said electrons generating unresolved ultraviolet output radiation for purposes of flooding an object with ultraviolet radiation.

12. The apparatus of claim 2 further comprising means for exposing said input window with a resolved image of ultraviolet light, whereby said image is amplified in intensity by said apparatus.

13. A method for curing an ultraviolet sensitive material comprising
   - placing a low-heat source of high intensity ultraviolet light in close proximity to said material and
   - irradiating said material with high intensity ultraviolet light,
   - said source comprising
     - an input substrate,
     - an electron-emitting cathode layer on said input substrate,
     - an output window,
     - a cathodoluminescent anode layer on said output window, said layer comprising phosphor luminescent in substantially only the ultraviolet spectrum,
     - an evacuated region separating said cathode and anode layers, and
   - a D.C. voltage source connected across said layers for generating a longitudinal electric field,
   - whereby electrons emitted by said cathode layer are accelerated by the electric field through said evacuated region and impinge on said cathodoluminescent layer causing a substantially pure, high-intensity ultraviolet light output through said output window.

14. The method of claim 13 wherein the emitting step comprises exposing to ultraviolet radiation an ultraviolet-sensitive layer which emits electrons when exposed to ultraviolet radiation.

15. The method of claim 13 wherein said source further comprises:

two electrodes consisting of coplanar, finely-spaced, interleaved fingers thinly deposited on said input substrate, a second D.C. voltage source connected to said two electrodes, and an electron-emitting layer deposited over said two electrodes and composed of material which emits electrons when exposed to an electric field, said electron-emitting layer emitting electrons when excited by a second electric field generated within it by said two electrodes transversely to said longitudinal electric field.

* * * * *